US010221056B2

(12) United States Patent
Podnar

(10) Patent No.: US 10,221,056 B2
(45) Date of Patent: Mar. 5, 2019

(54) COMPONENT MOVING SYSTEM AND METHOD

(71) Applicant: THE BOEING COMPANY, Chicago, IL (US)

(72) Inventor: Gregg W. Podnar, Seattle, WA (US)

(73) Assignee: The Boeing Company, Chicago, IL (US)

( * ) Notice: Subject to any disclaimer, the term of this patent is extended or adjusted under 35 U.S.C. 154(b) by 420 days.

(21) Appl. No.: 14/832,658

(22) Filed: Aug. 21, 2015

(65) Prior Publication Data

US 2017/0050830 A1 Feb. 23, 2017

(51) Int. Cl.
*B66F 9/14* (2006.01)
*B66F 9/075* (2006.01)

(52) U.S. Cl.
CPC ..... *B66F 9/07568* (2013.01); *B66F 9/147* (2013.01)

(58) Field of Classification Search
CPC ..... B66F 9/07568; B66F 9/147; B62D 61/06–61/08
USPC ..... 414/659; 180/211
See application file for complete search history.

(56) References Cited

U.S. PATENT DOCUMENTS 3,167,201 A * 1/1965 Quayle ..... B66F 9/122 414/664
3,168,956 A * 2/1965 Jinks ..... B62D 7/142 414/544
3,272,365 A * 9/1966 Stevens ..... B66F 9/10 187/222
4,024,968 A * 5/1977 Shaffer ..... B66F 9/07545 296/190.04
4,102,463 A * 7/1978 Schmidt ..... E04G 19/003 187/226
4,558,758 A * 12/1985 Littman ..... B62D 7/026 180/236
4,599,030 A * 7/1986 Skaalen ..... B62D 7/1509 180/236
4,690,609 A * 9/1987 Brown ..... B60P 3/055 296/186.4
4,823,899 A * 4/1989 Ron ..... B62D 7/1509 180/236
4,995,774 A * 2/1991 Nusbaum ..... B62D 7/026 180/234
6,135,704 A * 10/2000 Seaberg ..... B66F 9/183 294/119.1
6,913,102 B2 * 7/2005 Sugata ..... B60K 7/0007 180/236
7,841,822 B2 * 11/2010 Tygard ..... B66F 9/188 414/623
8,701,801 B2 * 4/2014 Itou ..... B60K 7/0007 180/234
8,944,446 B1 * 2/2015 Cottingham ..... B60B 19/003 180/252
9,434,412 B2 * 9/2016 Clark ..... B62D 7/1509

* cited by examiner

*Primary Examiner* — Jonathan Snelting
(74) *Attorney, Agent, or Firm* — Joseph M. Butscher; The Small Patent Law Group, LLC

(57) ABSTRACT

A component moving system may include a cart, and a component support assembly coupled to the cart. The component support assembly may include a component cradle moveable in first linear translational directions, second linear translational directions that are orthogonal to the first linear translational directions, third linear translation directions that are orthogonal to the first and second linear translational directions, and first rotational directions.

21 Claims, 9 Drawing Sheets

COMPONENT MOVING SYSTEM AND METHOD

FIELD OF THE DISCLOSURE

Embodiments of the present disclosure generally relate to systems and methods for moving large components, such as wings and landing gear assemblies of an aircraft during a manufacturing process.

BACKGROUND OF THE DISCLOSURE

An aircraft is typically manufactured in a large enclosed facility, such as a factory. Numerous components are assembled together to form the aircraft. For example, wings are separately formed from a fuselage. After a wing is formed at one location, the wing may be moved to another location within the facility where it is joined to a fuselage.

As can be appreciated, a wing of an aircraft (particularly of a large commercial aircraft) is large and heavy. Overhead crane systems are typically used to move the wings within the manufacturing facility. The overhead crane is used to separately pick up left and right wings from respective dollies, and transport them to a location of a fuselage. The same crane may then be used to sequentially pick up other components of the aircraft, such as landing gear, in order to transport them to the location of the fuselage. The crane is generally used to pick up and transport a single component (such as a wing or landing gear) at any one time. As such, the time to manufacture an aircraft depends, in part, on the time it takes for the crane to sequentially move various components. That is, because the crane is used to transport a single component at any one time, transportation of additional components to an assembly site is delayed until the crane completes transportation of the initial component. In short, use of the crane to transport various components to an assembly site may represent a bottleneck that increases a time of manufacture.

Accordingly, a need exists for an efficient system and method of moving large components within a facility. A need exists for an efficient method of manufacturing a vehicle, such as a commercial aircraft.

SUMMARY OF THE DISCLOSURE

Certain embodiments of the present disclosure provide a component moving system that is configured to move a component (such as a wing, landing gear, or the like) through a facility. The component moving system is a ground-based system. The component moving system may include a cart, and a component support assembly coupled to the cart. The component support assembly may include a component cradle moveable in first linear translational directions, second linear translational directions that are orthogonal to the first linear translational directions, third linear translation directions that are orthogonal to the first and second linear translational directions, and first rotational directions. The cart may be moveable in a forward direction, a reverse direction, a right direction, a left direction, and second rotational directions. Accordingly, the component moving system is configured to move in relation to seven different degrees of freedom.

The first linear translational directions may be lateral linear directions. The second linear translational directions may be longitudinal linear directions. The third linear translational directions may be vertical linear directions.

The cart may include one or more drive wheel assemblies. At least one of the drive wheel assemblies may include one or more drive wheels, and one or more drive motors configured to drive the drive wheel(s). The drive wheel assembly may also include one or more steering motors configured to steer the drive wheel(s). In at least one embodiment, a drive wheel assembly may include two coaxial drive wheels. Each of the two coaxial drive wheels may be differentially driven by the motor(s).

The cart may include a main body and one or more outriggers extending outwardly from a lower portion of the main body. Each of the outriggers may include a support wheel assembly including one or more support wheels. The support wheel assembly may also include one or more steering motors coupled to the support wheel(s). The steering motor(s) are configured to independently steer the support wheel(s) (independently of the drive wheels, for example).

The component cradle may be configured to support a component above (for example, on) and/or below a support surface. For example, the component cradle may include one or more hanging brackets extending downwardly from the component cradle. The hanging brackets may be configured to support a component below the component cradle.

The component support assembly may include a table including a fixed base and a frame rotatably secured to the fixed base. The component cradle is coupled to the frame. Rotation of the frame relative to the fixed base causes rotation of the component cradle in the first rotational directions.

The component support assembly may include first translators and second translators coupled to the component cradle. The first translators may be configured to move the component cradle in the first linear translational directions. The second translators may be configured to move the component cradle in the second linear translational directions.

The component support assembly may include one or more support columns, and one or more lift brackets moveably secured to the one or more support columns. The lift bracket(s) may be coupled to the component cradle. The lift bracket(s) may be configured to move the component cradle through the third linear directions.

The component cradle may include a support surface that may include at least one engaging pad configured to abut into a surface of a component. For example, the engaging pad(s) may abut into a lower surface of the component, such as a lower surface of a wing. The component cradle may also include at least one support configured to mate with a reciprocal opening of the component, such as an access port (or various other structures and features that are configured to restrict lateral and longitudinal shifting or other movement) formed in a wing.

The component cradle may also include at least one moveable beam that is moveable between positions to accommodate components of different shapes and sizes. For example, the moveable beam(s) may be rotated between first and second positions that are configured to support mirror image components, such as left and right wings.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Embodiments of the present disclosure provide a component moving system and method that may be used to transport various components to a particular site, such as an assembly site within a factory. The system and method may be used to transport components (such as wings and landing gear assemblies) without the use of overhead cranes, thereby allowing the cranes to be used to transport other components and utilized in a more efficient manner. The system and method may be used to transport various components on the ground and maneuver through confined, restricted, constricted, congested, or other such spaces on a floor of a manufacturing facility.

Certain embodiments of the present disclosure provide a system, such as a ground-based vehicle, for carrying and moving a load. The system may include a platform configured for omnidirectional translation, and a cradle for supporting the load. The cradle may be supported by the platform, and may be configured to be shifted in X and Y directions relative to the platform. The cradle is also configured to be raised and lowered relative to the platform along a Z direction, and is also capable of being rotated about a vertical axis. The system may be configured to support the load above and below the cradle. The system may also include a turntable supported by the platform. The turntable is configured to allow the load to be rotated about the vertical axis. The system may also include outriggers extending from the platform and positioned below the turntable. The outriggers may be independently steerable.

Embodiments of the present disclosure provide systems and methods that are configured to easily pick up a large and heavy component at a first position and orientation, and maneuver and orient the component to clear obstacles on a floor of a manufacturing facility (such as a factory). The system and method may be used to deliver the component to a second site (such as an assembly site) at a second position and orientation that may differ from the first position and orientation.

Figure 1:
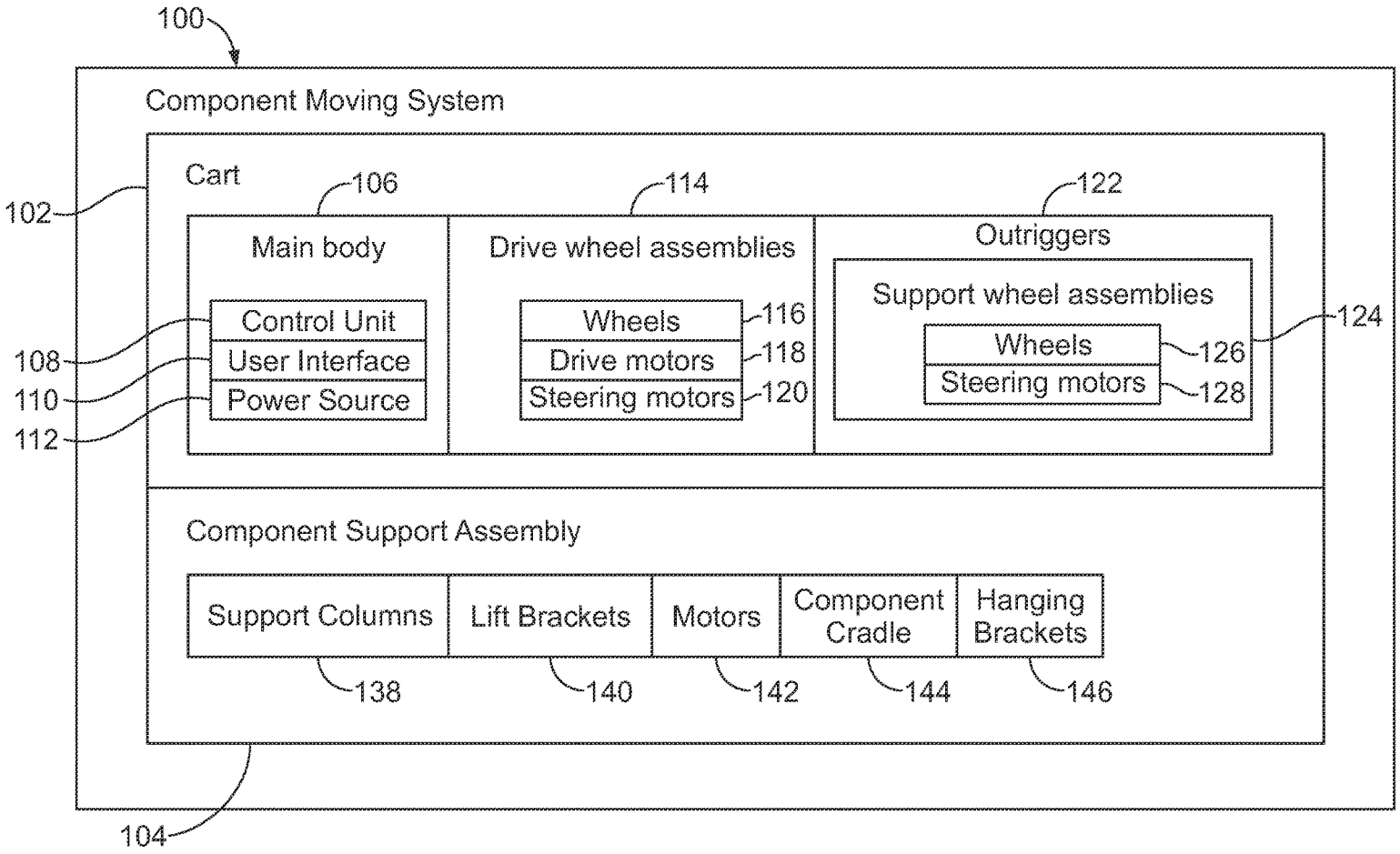
FIG. 1 illustrates a block diagram of a component moving system, according to an embodiment of the present disclosure.

FIG. 1 illustrates a block diagram of a component moving system 100, according to an embodiment of the present disclosure. The component moving system 100 may include a cart 102 and a component support assembly 104. The system 100 may be a ground-based vehicle that is used to transport various components on the component support assembly 104.

The cart 102 may include a main body 106, which may include a control unit 108, a user interface 110, and a power source 112. The user interface 110 is coupled to the control unit 108 and may include one or more of a joystick, a steering wheel, an accelerator pedal or button, and a brake pedal or button. For example, the user interface 110 is used to direct and control movement of the component moving system 100, as well as the component support assembly 104, as described below. The power source 112 is configured to provide power to the component moving system 100 for operation, and may include one or more of a battery, an internal combustion engine, and/or the like.

The control unit 108 may be used to control operations of the component moving system 100, as described in the present application. As used herein, the term "control unit," "unit," "central processing unit," "CPU," "computer," or the like may include any processor-based or microprocessor-based system including systems using microcontrollers, reduced instruction set computers (RISC), application specific integrated circuits (ASICs), logic circuits, and any other circuit or processor including hardware, software, or a combination thereof capable of executing the functions described herein. Such are exemplary only, and are thus not intended to limit in any way the definition and/or meaning of such terms. For example, the control unit 108 may be or include one or more processors that are configured to control operation and movement of the cart 102, and operation and movement of the component support assembly 104.

The control unit 108, for example, is configured to execute a set of instructions that are stored in one or more storage elements (such as one or more memories), in order to process data. For example, the control unit 108 may include or be coupled to one or more memories. The storage elements may also store data or other information as desired or needed. The storage elements may be in the form of an information source or a physical memory element within a processing machine.

The set of instructions may include various commands that instruct the control unit 108 as a processing machine to perform specific operations such as the methods and processes of the various embodiments of the subject matter described herein. The set of instructions may be in the form of a software program. The software may be in various forms such as system software or application software. Further, the software may be in the form of a collection of separate programs, a program subset within a larger program or a portion of a program. The software may also include modular programming in the form of object-oriented programming. The processing of input data by the processing machine may be in response to user commands, or in response to results of previous processing, or in response to a request made by another processing machine.

The diagrams of embodiments herein may illustrate one or more control or processing units, such as the control unit 108 shown in FIG. 1. It is to be understood that the processing or control units may represent circuits, circuitry, or portions thereof that may be implemented as hardware with associated instructions (e.g., software stored on a tangible and non-transitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, the control unit 108 may represent processing circuitry such as one or more of a field programmable gate array (FPGA), application specific integrated circuit (ASIC), microprocessor(s), a quantum computing device, and/or the like. The circuits in various embodiments may be configured to execute one or more algorithms to perform functions described herein. The one or more algorithms may include aspects of embodiments disclosed herein, whether or not expressly identified in a flowchart or a method.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

The cart 102 may also include one or more drive wheel assemblies 114, which may be operatively coupled to the control unit 108. Each drive wheel assembly 114 may include one or more wheels 116, one or more drive motors 118 configured to drive the wheels 116 in response to user commands input through the user interface 110, and one or more steering motors 120 configured to steer the wheels 116 in response to user commands input through the user interface 110. Optionally, the drive wheel assembly 114 may not include separate and distinct steering motors 120. Instead, the wheels 116 may be steered through differentially-driven wheels 116, such as differentially-driven dual wheels.

The cart 102 may also include outriggers 122 outwardly extending from the main body 106. Each outrigger 122 may include a support wheel assembly 124, which may be operatively coupled to the control unit 108. Each support wheel assembly 124 may include one or more wheels 126 and one or more steering motors 128 configured to steer the wheels 126 in response to user commands.

The component support assembly 104 may include one or more support columns 138. One or both of the support columns 138 and/or the outriggers 122 of the cart 102 may form a platform that is configured to support a component cradle 144. One or more lift brackets 140 may be moveably secured on the support columns 138. For example, the lift brackets 140 may be operatively coupled to one or more motors 142 that are coupled to the control unit 108. The motors 142 may be used to lift and lower the lift brackets 140 based on user commands input through the user interface 110.

The component support assembly 104 also includes the component cradle 144 that may be used to support a component. For example, the component may be supported above (such as on) support surfaces (such as rails, beams, arms, engaging pads, or the like) of the component cradle 144. The motors 142 may be used to control movement of the component cradle 144 based on user commands input through the user interface 110. Alternatively, the component cradle 144 may not be coupled to the motors 142. As such, the component cradle 144 may be configured to be manually moved.

The component support assembly 104 may also include one or more hanging brackets 146 coupled to the component cradle 144. The hanging brackets 146 may secure to the component cradle 144 and may be used to support a component below the component cradle 144.

Figure 2:
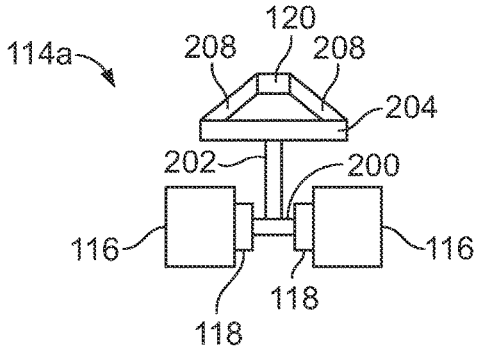
FIG. 2 illustrates a simplified front view of a drive wheel assembly, according to an embodiment of the present disclosure.

FIG. 2 illustrates a simplified front view of a drive wheel assembly 114*a*, according to an embodiment of the present disclosure. The drive wheel assembly 114*a* may include two coaxial wheels 116 connected to a common axle 200. Each wheel 116 may be independently and differentially driven by a respective drive motor 118. The axle 200 may be connected to a post 202 that is connected to a rotatable member 204, such as a disc, gear, pinion, or the like. The rotatable member 204 is operatively coupled to a steering motor 120 through one or more links 208, such as a drive belt, one or more pulleys, a rack, and/or the like.

In operation, the wheels 116 may be independently driven by the drive motors 118, which may be communicatively coupled to the control unit 108 (shown in FIG. 1), based on user commands input through the user interface 110 (shown in FIG. 1). The drive motors 118 operate to the move the wheels 116 forward or in reverse. Additionally, the drive motors 118 may be used to stop the wheels 116, such as through braking. Optionally, separate and distinct brakes may be used to stop the wheels.

The steering motor 120 may be used to turn the wheels 116 right or left. For example, in response to user commands input through the user interface 110, the steering motor 120 rotates the rotatable member 204 in a desired direction, which, in turn, rotates the post 202, thereby causing a corresponding rotation of the wheels 116 about a central axis of the post 202.

In at least one embodiment, the drive wheel assembly 114*a* may not include the separate and distinct steering motor 120. Instead, because the wheels 116 may be differentially driven, the drive wheel assembly 114*a* may be steered through differential driving of the wheels 116. In this manner, the differential driven wheels 116 may provide a simpler method of steering the drive wheel assembly 114*a*. Further, the differentially-driven wheels 116 provide a drive wheel assembly 114*a* that may be more responsive to user commands and easier to turn.

Alternatively, the wheels 116 may not be connected by a common axle. Instead, separate and distinct axles may connect to each wheel 116. Additionally, the drive motors 118 may or may not be directly secure to the wheels 116. For example, each drive motor 118 may be coupled to a wheel 116 through a connecting link. Also, alternatively, the steering motor 120 may operatively connect to the wheels 116 through various other interfaces other than shown. In at least one embodiment, the steering motor 120 may be directly connected to the axle 200. In at least one other embodiment, the steering motor 120 may couple to fixed frames connected to inner or outer portions of the wheels 116. In another embodiment, the steering motor 120 may be directly connected to the post 202 without the intermediary rotatable member 204.

Figure 3:
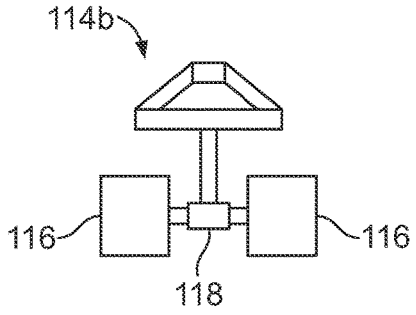
FIG. 3 illustrates a simplified front view of a drive wheel assembly, according to an embodiment of the present disclosure.

FIG. 3 illustrates a simplified front view of a drive wheel assembly 114*b*, according to an embodiment of the present disclosure. The drive wheel assembly 114*b* is similar to the drive wheel assembly 114*a* shown in FIG. 2, except that a single drive motor 118 may be used to drive the wheels 116. The single drive motor 118 may be configured to differentially drive the two wheels 116.

Figure 4:
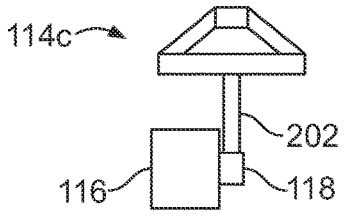
FIG. 4 illustrates a simplified front view of a drive wheel assembly, according to an embodiment of the present disclosure.

FIG. 4 illustrates a simplified front view of a drive wheel assembly 114*c*, according to an embodiment of the present disclosure. The drive wheel assembly 114*c* is similar to the drive wheel assembly 114*a* shown in FIG. 2, except that the drive wheel assembly 114 may include a single wheel 116 coupled to a motor 118. As shown, the wheel 116 may be offset to a side of a central axis of the post 202.

Figure 5:
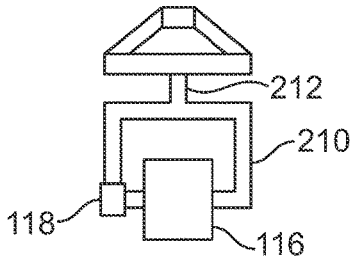
FIG. 5 illustrates a simplified front view of a drive wheel assembly, according to an embodiment of the present disclosure.

FIG. 5 illustrates a simplified front view of a drive wheel assembly 114*d*, according to an embodiment of the present disclosure. The drive wheel assembly 114*d* is similar to the drive wheel assembly 114*c* shown in FIG. 4, except that a connecting bracket 210 may be used to center the wheel 116 with respect to a central axis of the post 212.

FIGS. 2-5 show examples of drive wheel assemblies 114. It is to be understood, however, that various other types of drive wheel assemblies other than shown may be used. For example, a drive wheel assembly 114 may include more than two wheels. Further, not all of the wheels of a drive wheel assembly 114 may be powered through a motor. For example, as shown in FIG. 2, only one of the wheels 116 may be coupled to a motor 118, while the other wheel may not be coupled to a motor.

Figure 6:
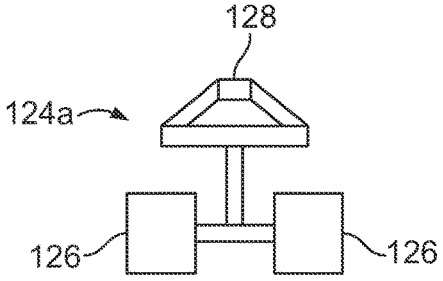
FIG. 6 illustrates a simplified front view of a support wheel assembly, according to an embodiment of the present disclosure.

FIG. 6 illustrates a simplified front view of a support wheel assembly 124*a*, according to an embodiment of the present disclosure. The support wheel assembly 124*a* is similar to the drive wheel assemblies shown and described in FIGS. 2-5. For example, the support wheel assembly 124*a* includes wheels 126 operatively coupled to a steering motor 128, similar to as described above with respect to FIG. 2. Unlike the drive wheel assemblies 124, the support wheel assembly 124 may not include drive motors coupled to the wheels 126. Instead, the wheels 126 may be passive and move in response to movement of the drive wheel assemblies 114. The support wheel assembly 124 may be independently steered through the steering motor 128. Because the support wheel assembly 124*a* is independently steered, the support wheel assembly 124*a* is uniquely adapted to handle heavy components. For example, non-steered casters may buckle or otherwise be difficult to turn when supporting the weight of at least part of a heavy component, such as an airplane wing. In contrast, the steerable support wheel assembly 124*a* is independently steered and may be easily turned based on a command input through the user interface, whether or not the component cradle 144 is supporting a component.

Figure 7:
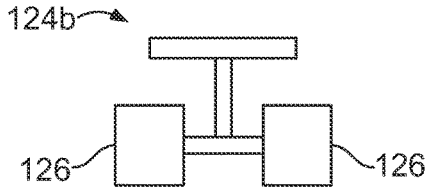
FIG. 7 illustrates a simplified front view of a support wheel assembly, according to an embodiment of the present disclosure.

FIG. 7 illustrates a simplified front view of a support wheel assembly 124*b*, according to an embodiment of the present disclosure. The support wheel assembly 124*b* is similar to the support wheel assembly 124*a* shown in FIG. 6, except that the support wheel assembly 124*b* does not include a steering motor. As such, all movement of the support wheel assembly 124*b* is passive (both in terms of forward and reverse movement, as well as rotational steering). In this manner, the support wheel assembly 124*b* may be or include passive casters.

Referring to FIGS. 6 and 7, the support wheel assemblies may include more or less wheels than shown. For example, the support wheel assemblies may include a single wheel, similar to those shown in FIGS. 4 and 5. In at least one other embodiment, the support wheel assemblies may include drive motors that are configured to independently drive the wheels 126.

Figure 8:
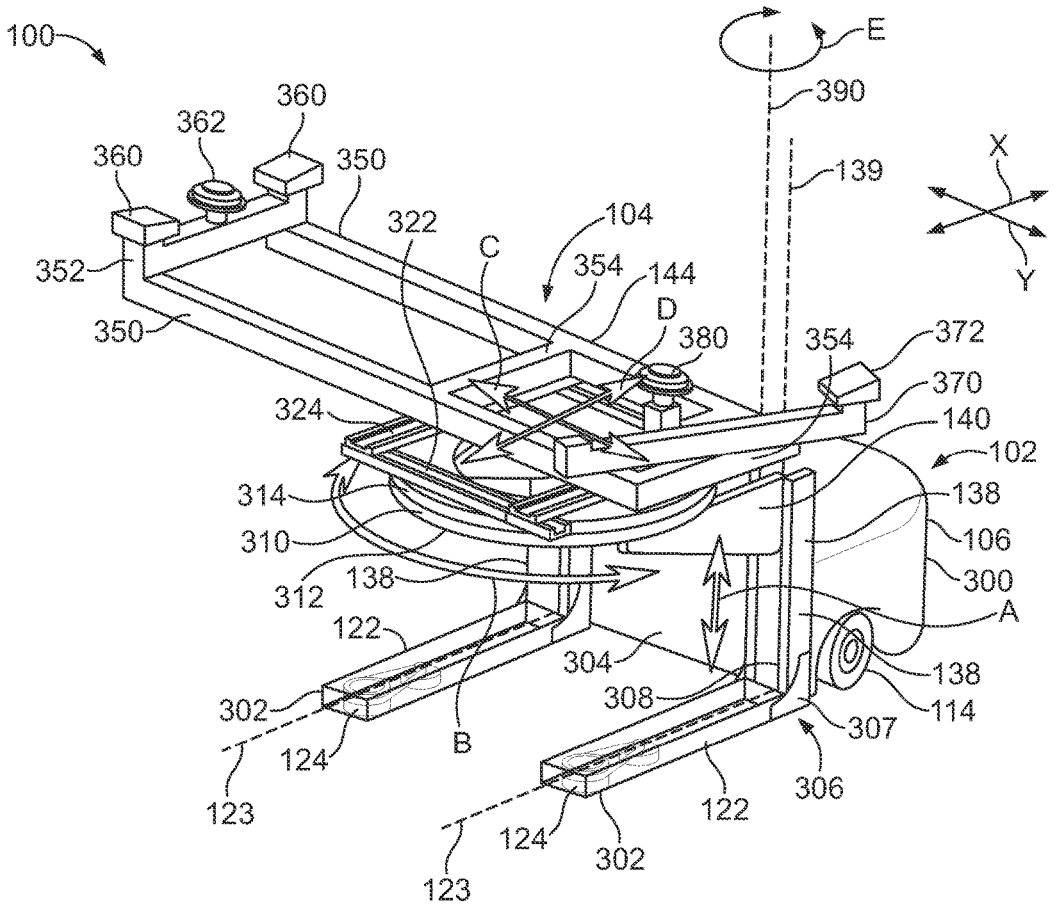
FIG. 8 illustrates a perspective top view of a component moving system, according to an embodiment of the present disclosure.

FIG. 8 illustrates a perspective top view of the component moving system 100, according to an embodiment of the present disclosure. Referring to FIGS. 1 and 8, the control unit 108 and the power source 112 may be contained within a housing 300 of the main body 106. The user interface 110 may be located on an outer surface of the housing 300, such as a top rear surface. In at least one other embodiment, the user interface 110 may be a remote device that is coupled to the control unit 108 through a wired or wireless connection. As such, the user interface 110 may allow an operator to move about and around the component moving system 100 in order to assess clearance space between the component moving system 100 and objects within a facility that are proximate to the component moving system 100. The cart 102 may be configured to be operated by an individual standing behind the housing 300 (distally positioned from the outriggers 122) and/or on a platform extending from the housing 300. In at least one other embodiment, the cart 102 may include a cabin having a seat on which an operator may sit.

The component moving system 100 may include two parallel outriggers 122 extending from a lower portion of the housing 300. Alternatively, the outriggers 122 may not be parallel. For example, the outriggers 122 may be splayed. Each outrigger 122 may include a support wheel assembly 124 at a distal end 302. Each outrigger 122 may be secured to a support column 138 at a right angle. For example, the support columns 138 may be secured in an upright vertical position to a front surface 304 of the housing 300. The outriggers 122 extend outwardly from lower ends of the support columns 138. Lateral braces 307 may connect outer lateral surfaces of the outriggers 122 and the support columns 138 together and provide a bracing support that prevents the outriggers 122 from bending back toward the support columns 138. The support columns 138 and the outriggers 122 may form a platform 306 for the component support assembly 104 to support a component, such as a wing that is to be assembled to a fuselage of an aircraft. Alternatively, the component moving system 100 may include a single outrigger 122, more than two outriggers 122, or even no outriggers. For example, the main body 106 may be of sufficient mass that the outriggers are not needed, as the mass of the main body 106 may be sufficient to counter balance a load supported on the component cradle 144.

Each support column 138 includes a central vertical channel 308 that retains an end of a lift bracket 140. As shown, the component support assembly 104 may include two parallel lift brackets 140, although more or less lift brackets 140 than shown may be used. The lift brackets 140 may be operatively coupled to motors 142 (hidden from view in FIG. 8) that are configured to move the lift brackets 140 (and therefore the component cradle 144) up or down in vertical directions (or directions that are parallel to longitudinal axes of the support columns 138) in the directions of arrow A, which are vertical directions that are parallel to vertical axes 139 of the support columns 138.

The component support assembly 104 may include a table 310 that connects to upper portions of the lift brackets 140. For example, the table 310 may be secured to upper edges of the lift brackets 140 through one or more fittings, fasteners, bonding, and/or the like. The table 310 may include a fixed base 312 connected to a rotatable frame 314 that is rotatably secured to the base 312. For example, the rotatable frame 314 may be rotatably secured to the base 312 through a circular rack and pinion(s), ball bearings, sliding tracks, and/or the like. The rotatable frame 314 may be operatively coupled to one or more motors 142 that are configured to provide controlled, powered rotation of the rotatable frame 314 (and therefore the component cradle 144) in response to a command input through the user interface 110.

Alternatively, the rotatable frame 314 may not be operatively coupled to a motor. Instead, the rotatable frame 314 may be configured to be manually rotated. In such an embodiment, the component support assembly 104 may include one or more leveling sensors that are configured to ensure that the rotatable frame 314 remains level. Further, one or more locks (such as clamps, latches, or the like) may be used to securely lock the rotatable frame 314 in position relative to the base 312 after the rotatable frame 314 has been moved to a desired rotatable position.

In operation, the rotatable frame 314 may be rotated about a central axis of the table 310 in directions denoted by arc B. Rotation of the rotatable frame 314 causes a corresponding rotation of the component cradle 144.

A first set of translators 322 are secured on top of the rotatable frame 314. For example, a pair of parallel translators 322 may be secured on top of the rotatable frame 314. A second set of translators 324 may be secured over the first set of translators 314. The second set of translators 324 may be orthogonal (such as oriented at a right angle) to the first set of translators 322.

Figure 9:
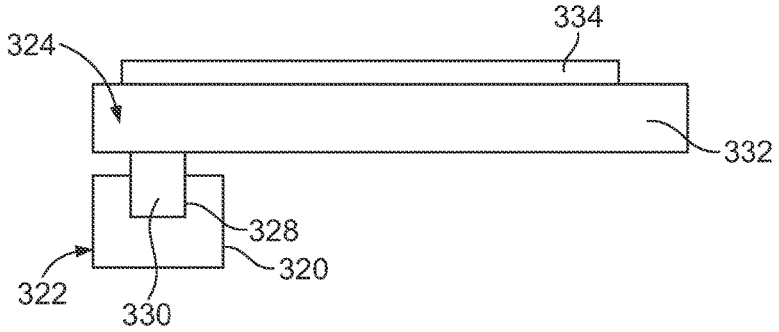
FIG. 9 illustrates a simplified view of a first translator coupled to a second translator, according to an embodiment of the present disclosure.

FIG. 9 illustrates a simplified view of a first translator 322 coupled to a second translator 324, according to an embodiment of the present disclosure. The first translator 322 includes a bracket 326 defining a track 328 into which a slide beam 330 is slidably retained. The slide beam 330 is configured to slide within the track 328. An upper surface of the slide beam 330 supports a bracket 332 of the second translator 324. The bracket 332 also slidably retains a slide beam 334 within a track. Optionally, the translators 322 and 324 may be configured as various other devices that are configured to translate in and out. For example, the translators 322 and 324 may include telescoping portions, pistons, scissoring extension devices, and/or the like.

Referring to FIGS. 1, 8 and 9, the second translators 322 may be slid on the first translators 324 in the directions of arrow C, which may be linear directions (such as longitudinal directions in relation to the component cradle 144) that are perpendicular to longitudinal axes 123 (as shown in FIG. 8) of the outriggers 122, as shown in the orientation of FIG. 8). For example, the slide beams 320 of the first translators 322 may be slid through the tracks 328 of the brackets 326, thereby sliding the second translators 324 in response. Similarly, the slide beams 334 of the second translators 324 may be slid through the tracks of the brackets 332 in directions denoted by arrows D, which are orthogonal to the directions of arrows C, and which may be linear directions (such as lateral directions in relation to the component cradle 144) that are parallel to the longitudinal axes 123 of the outriggers 122, as shown in the orientation depicted in FIG. 8. Upper surfaces of the slide beams 334 are secured to a lower surface of the component cradle 144. Accordingly, the first translators 322 may be operated to move the component cradle 144 in the directions of arrows C, while the second translators 324 may be operated to move the component cradle 144 in the directions of arrows D.

The first and second translators 322 and 324 may be operatively coupled to one or more motors 142 (for example, the slide beams 330 and 334 may be operatively coupled to one or more motors 142) that are configured to provide controlled, powered translation of the component cradle 144 in the directions of arrows C and D, based on commands input through the user interface 110. Alternatively, the first and second translators 322 and 324 may not be operatively coupled to a motor. Instead, the component cradle 144 may be configured to be manually translated by way of the first and second translators 322 and 324. In such an embodiment, the component support assembly 104 may include one or more leveling sensors that are configured to ensure that the first and second translators 322 and 324 remain level. Further, one or more locks (such as clamps, latches, or the like) may be used to securely lock the first and second translators 322 and 324 after a desired translated position has been achieved.

The component cradle 144 may include one or more extension beams 350 that are secured to the second translators 324, such as to the slide beams 334 of the second translators 324 (for example, through fasteners, bonding, and/or the like). A component supporting cross beam 352 may span between parallel extension beams 350 at a first end of the component cradle 144. One or more additional cross beams 354 may be secured between the extension beams 350.

The component support cross beam 352 may include engaging pads 360 extending upwardly therefrom. Additionally an oval support 362 may also upwardly extend from the component support cross beam 352. The engaging pads 360 and the oval support 362 may include rubber contact surfaces that are configured to engage a surface of a component, such as a lower surface of a wing. The oval support 362 may be sized and shaped to fit into or on a reciprocal oval access port formed through a lower surface of a wing. More or less engaging pads 360 than shown may be used. Additionally, the component support cross beam 352 may include more or less oval supports 362 than shown. In at least one other embodiment, the component support cross beam 352 may include various other support surfaces other than pads and oval supports. For example, an upper surface of the component support cross beam 352 may include a channel, which may be sized and shaped (such as cupped, recessed, or the like) to conform to a lower surface of a component to be moved.

An additional component support cross beam 370 may be rotatably secured to the extension beams 350 opposite from the component support cross beam 352. The support cross beam 370 may be rotated into various positions to accommodate components of different shapes and sizes. For example, the support cross beam 370 may be rotated between first and second positions that are opposite from one another to accommodate a left wing and a right wing. The component support cross beam 370 may include engaging pads 372 and/or one or more oval supports, such as the oval support 362. Optionally, the support cross beam 370 may not include an oval support 362.

One or more additional oval supports 380 may extend from the extension beams 350 and/or the cross beams 354. More or less oval supports than shown may be used. Again, the oval supports 380 may be configured to be secured into reciprocal oval access ports formed in a component, such as a wing.

In operation, the component moving system 100 is configured for movement with respect to seven separate and distinct degrees of freedom. First, the cart 102 may be operated to drive the component moving system 100 in forward and reverse directions denoted by arrows X. Second, the cart 102 may be operated to drive the component moving system 100 in left and right directions denoted by arrows Y, which are orthogonal to arrows X. Third, the cart 102 may be rotated about a vertical axis 390 (in relation to a floor) in the direction of arrow E. The axis 390 may be anywhere in relation to the cart 102. For example, the axis 390 may be in volume of space between the main body 106, and the outriggers 122. As such, the cart 102 may be omni-directionally driven in any direction along any straight line or arc of any radius. Fourth, the lift brackets 140 may be used to raise and lower the component cradle 144 in the direction of arrows A. Fifth, the table 310 may be operated to rotate the component cradle about a central axis of the table 310 in the directions of arc B. Sixth, the first translators 322 may be operated to linearly translate the component cradle 144 relative to the table 310 in the directions of arrows C. Seventh, the second translators 324 may be operated to linearly translate the component cradle 144 relative to the table 310 in the directions of arrows D, which are orthogonal to arrows C.

Due to the seven degrees of freedom, the component moving system 100 is particularly adapted to move a component (such as a wing) on the ground through a manufacturing facility while avoiding various obstacles. In short, the position and orientation of a component supported on the component cradle 144 may be continually adjusted as the component moving system 100 is driven and maneuvered through the facility to avoid various obstacles, structures, and the like.

Figure 10:
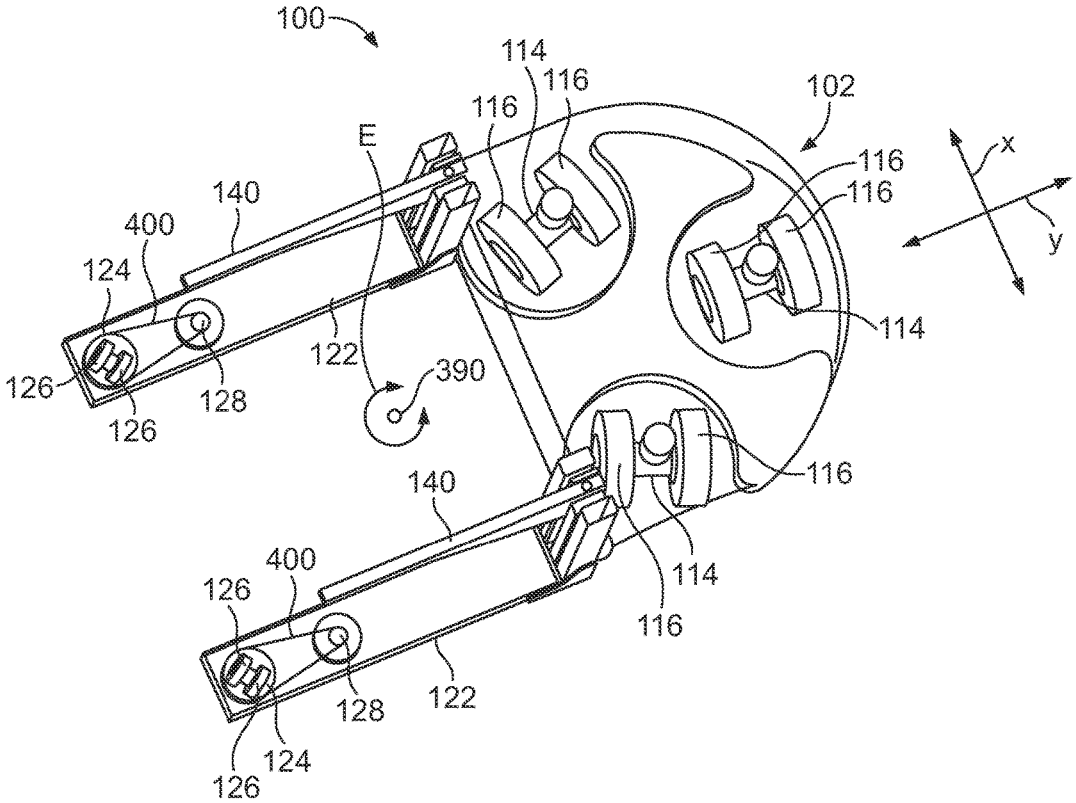
FIG. 10 illustrates a top view of a cart of a component moving system, according to an embodiment of the present disclosure.

FIG. 10 illustrates a top view of the component moving system 100, according to an embodiment of the present disclosure. For the sake of clarity, the component support assembly 104 is not shown in FIG. 10. As shown, the component moving system 100 may include three drive wheel assemblies 114. Each of the drive wheel assemblies 114 may include two coaxial wheels 116. Each of the coaxial wheels 116 may be independently driven by a drive motor, as described above. Further, each drive wheel assembly 114 may include a steering motor, as described above. Optionally, less than all three of the drive wheel assemblies 114 may include a drive motor and a steering motor.

Each of the outriggers 122 may include a support wheel assembly 124 at a distal end. Each support wheel assembly 124 may be independently steered by a steering motor 128 that is operatively coupled to wheels 126 through a linking belt 400. As shown, each support wheel assembly 124 may include two coaxial wheels 126. The support wheel assemblies 124 may be steered independently of the drive wheel assemblies 114.

The cart 102 may rotate the component moving system 100 about the vertical axis 390 in the directions of arc E. The axis 390 of rotation may extend vertically from any point on a floor that supports the cart 102. The drive wheel assemblies 114 may be driven and steered to rotate the component moving system 100 in the directions of arc E. Additionally, the drive wheel assemblies 114 may be driven and/or steered to move the component moving system 100 in forward and reverse in the directions of arrow Y, as well as laterally in the directions of arrow X, a combination of directions of arrows X and Y, and even while rotating about the axis 390, which may extend from any point on a floor that supports the cart 102.

Figure 11:
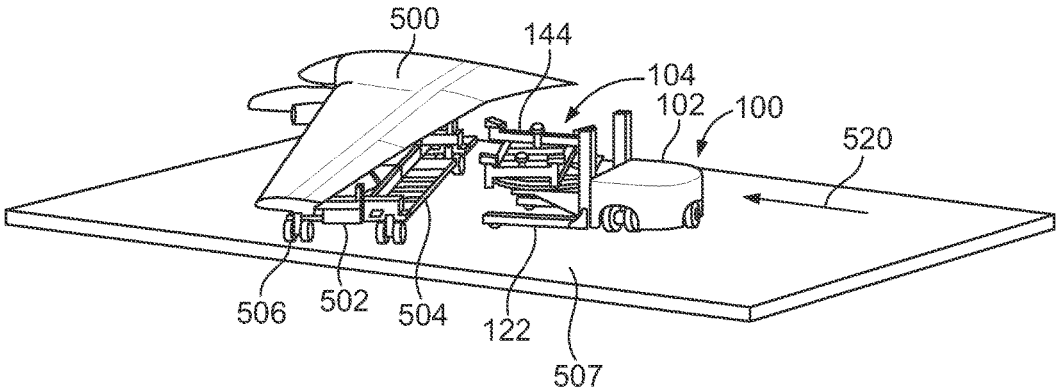
FIG. 11 illustrates a perspective view of a component moving system approaching a wing supported on a transportation dolly, according to an embodiment of the present disclosure.

FIG. 11 illustrates a perspective view of the component moving system 100 approaching a wing 500 supported on a transportation dolly 502, according to an embodiment of the present disclosure. The component moving system 100 is maneuvered into position so that the component cradle 144 is aligned with a space between an underside of the wing 500 and a base 504 of the transportation dolly 502. The transportation dolly 502 is supported by wheels 506 that position the base 504 off a floor 507. Accordingly, the component moving system 100 may be operated to move the outriggers 122 underneath the base 504. After the component moving system 100 is moved into an initial approach position as shown in FIG. 11, the component moving system 100 moves towards the wing 500 in the direction of 520 so that the component cradle 144 is positioned underneath the wing 500.

Figure 12:
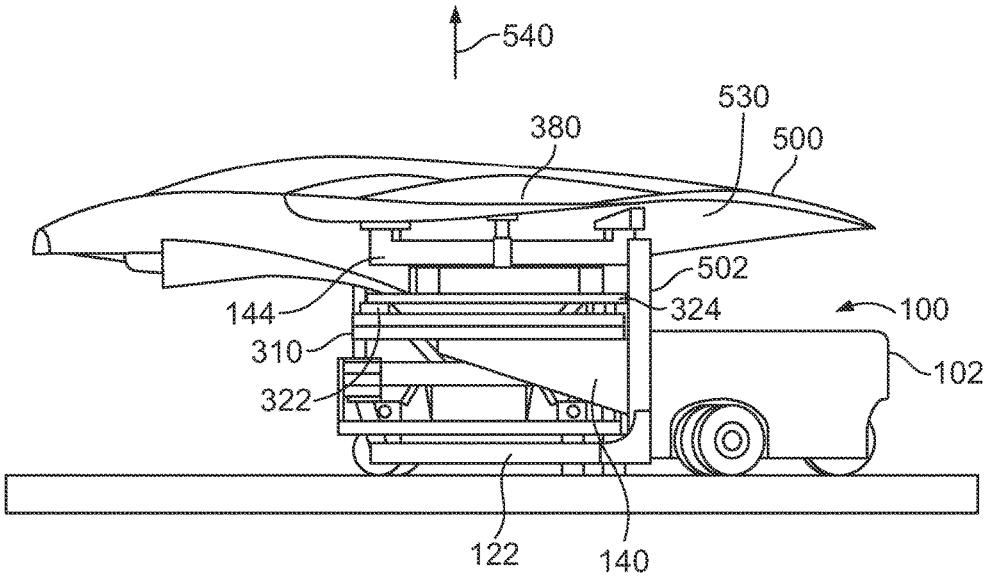
FIG. 12 illustrates a lateral view of a component moving system initially engaging a wing supported on a transportation dolly, according to an embodiment of the present disclosure.

FIG. 12 illustrates a lateral view of the component moving system 100 initially engaging the wing 500 supported on the transportation dolly 502, according to an embodiment of the present disclosure. The component cradle 144 may be maneuvered into position through rotational operation of the table 310 and the translators 322 and 324, as described above. Engaging pads 372 (and 360, as shown in FIG. 8) may abut into the lower surface 530 of the wing 500. Further, oval supports 380 (and 362 as shown in FIG. 8) may be positioned within reciprocal oval access ports formed within or through the lower surface 530. After the component moving system 100 initially engages the wing 500 as shown in FIG. 12, the lift brackets 140 may be moved to raise the wing 500 off the transportation dolly 502 in the direction of arrow 540.

Figure 13:
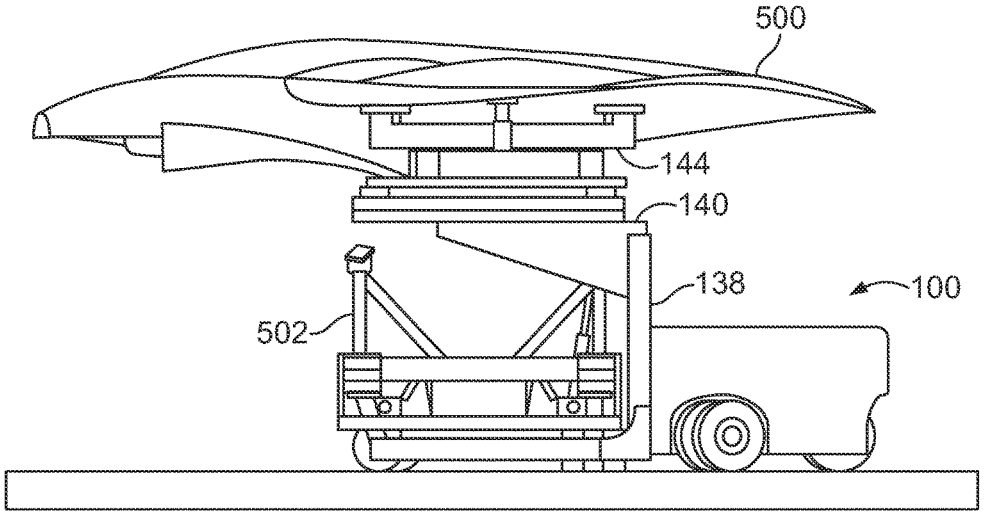
FIG. 13 illustrates a lateral view of a component moving system moving a wing off a transportation dolly, according to an embodiment of the present disclosure.

FIG. 13 illustrates a lateral view of the component moving system 100 moving the wing 500 off the transportation dolly 502, according to an embodiment of the present disclosure. As shown, the lift brackets 140 have moved up relative to the support columns 138 to lift the wing 500 off the transportation dolly 502. After the wing 500 is moved off the transportation dolly 502, the component moving system 100 may reverse away from the transportation dolly 502 and then maneuver the wing 500 to an assembly site.

Figure 14:
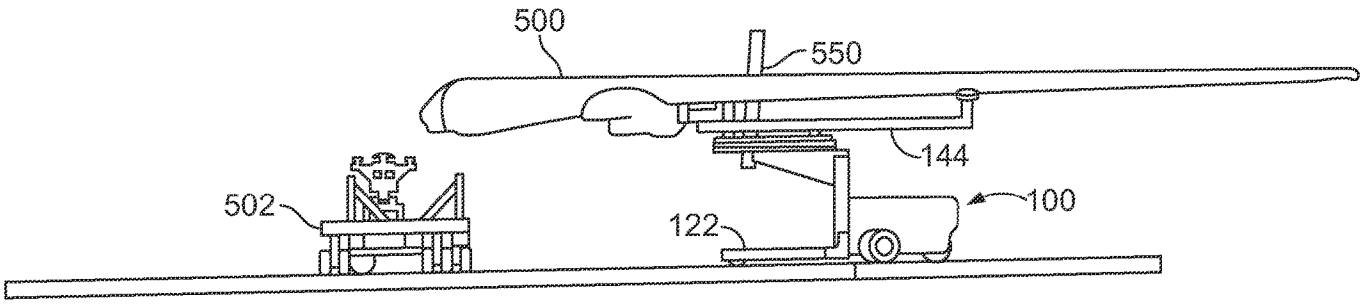
FIG. 14 illustrates a lateral view of a component moving system supporting a wing and moved away from a transportation dolly, according to an embodiment of the present disclosure.

FIG. 14 illustrates a lateral view of the component moving system 100 supporting the wing 500 and moved away from the transportation dolly 502, according to an embodiment of the present disclosure. The wing 500 has a center of gravity 550. The component moving system 100 may be operated and maneuvered to engage and lift the wing 500 such that the center of gravity 550 is within a supporting stance of the component moving system 100. For example, the center of gravity 550 is not at a position that outwardly extends past a length of the outriggers 122. As such, the wing 500 is not susceptible to tipping off the component cradle 144 or tipping the component moving system 100. In comparison to FIG. 13, the component cradle 144 shown in FIG. 14 has been rotated to re-orient the wing 500. The component moving system 100 may then move the wing 500 to an assembly site.

Figure 15:
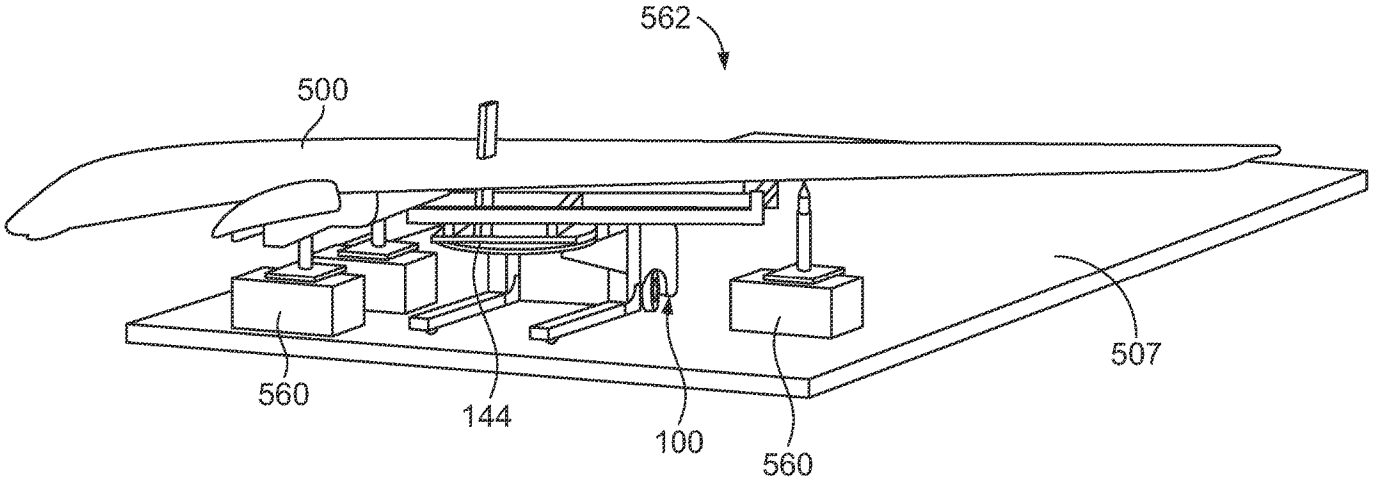
FIG. 15 illustrates a perspective view of a component moving system lowering a wing onto assembly supports at an assembly site, according to an embodiment of the present disclosure.

FIG. 15 illustrates a perspective view of the component moving system 100 lowering the wing 500 onto assembly supports 560 at an assembly site 562, according to an embodiment of the present disclosure. The component moving system 100 may be maneuvered through a facility on the floor 507 and moved between the assembly supports 560. The component moving system 100 may then lower the component cradle 144 so that the lower surfaces of the wings 500 are supported by the assembly supports 560. The component cradle 144 may continue to be lowered until it disengages the wing 500, at which point the component moving system 100 may be moved away from the wing 500.

Referring to FIGS. 1-15, the component moving system 100 is able to move in relation to seven degrees of freedom to move a component, such as the wing 500, between various positions within a facility, such as a factory. The component moving system 100 is ground based. Therefore, a crane is not needed to move the components. Instead, the crane may be reserved for other moving operations, thereby increasing the efficiency of a manufacturing process. Notably, the component moving system 100 may be used to support a component on top of the component cradle 144. As described below, the component moving system 100 may also be used to support a component below the component cradle 144.

Figure 16:
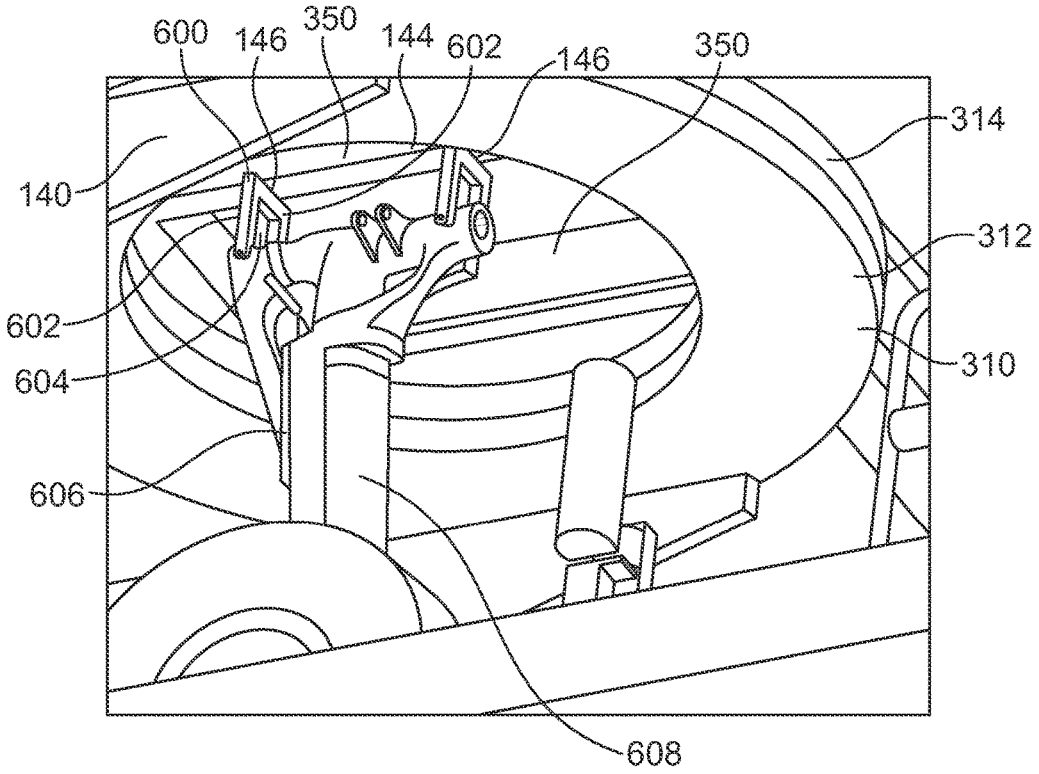
FIG. 16 illustrates a perspective bottom view of a component cradle of a component moving system, according to an embodiment of the present disclosure.

FIG. 16 illustrates a perspective bottom view of the component cradle 144 of the component moving system 100, according to an embodiment of the present disclosure. Hanging brackets 146 may downwardly extend from extension beams 350 and/or a cross beam (such as the cross beam 354) of the component cradle 144. The hanging brackets 146 may be separately affixed and secured to the component cradle 144, such as through fasteners, bonding, and/or the like. Optionally, the hanging brackets 146 may be integrally formed with the component cradle 144.

Each hanging bracket 146 may include an upper cross beam 600 secured to the component cradle 144. Connection prongs 602 extend downwardly from the cross beam 600. The connection prongs 602 are separated by a gap 604. Distal ends of the prongs 602 may include connection members (such as pins, bolts, latches, clasps, barbs, and/or the like) that are configured to securely mate with reciprocal features on a component. For example, the connection members may mate into reciprocal channels formed through a leg 606 of a landing gear 608. More or less hanging brackets 146 than shown may be used. Further, the handing brackets 146 may extend from various other portions of the component cradle 144 other than shown.

Figure 17:
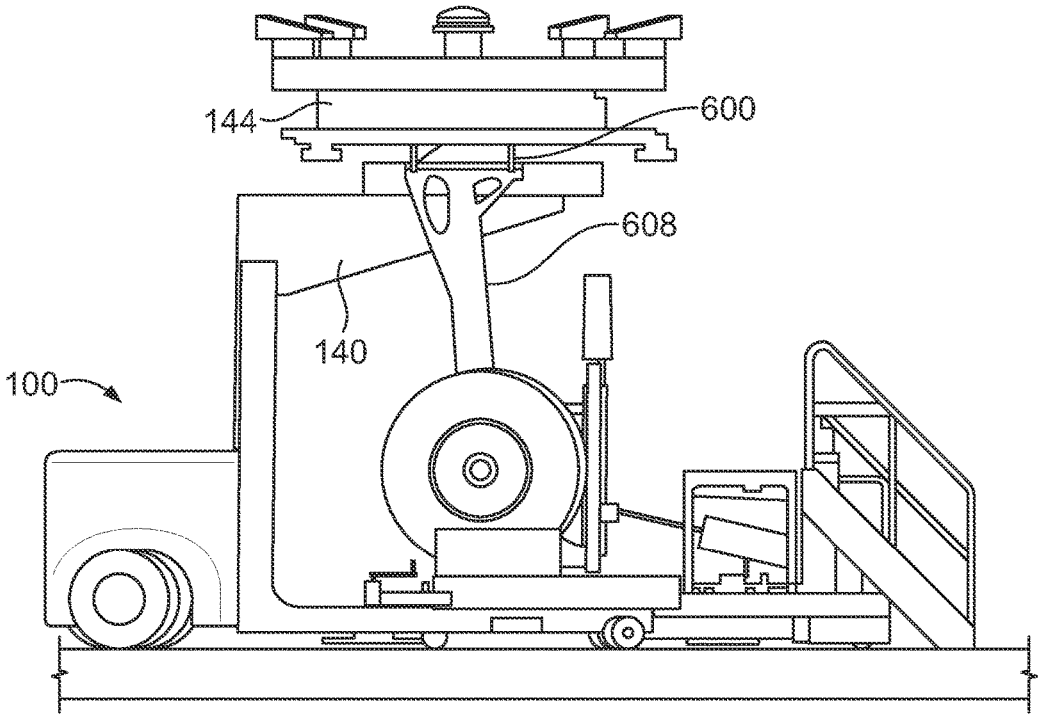
FIG. 17 illustrates a lateral view of a component moving system supporting a landing gear below a component cradle, according to an embodiment of the present disclosure.

FIG. 17 illustrates a lateral view of the component moving system 100 supporting the landing gear 608 below the component cradle 144, according to an embodiment of the present disclosure. The hanging brackets 146 securely connect to the landing gear 608, as described above. Once the landing gear 608 is connected to the hanging brackets 146, the component moving system 100 may be operated to move the landing gear 608 within a facility with respect to the seven degrees of freedom as described above.

Figure 18:
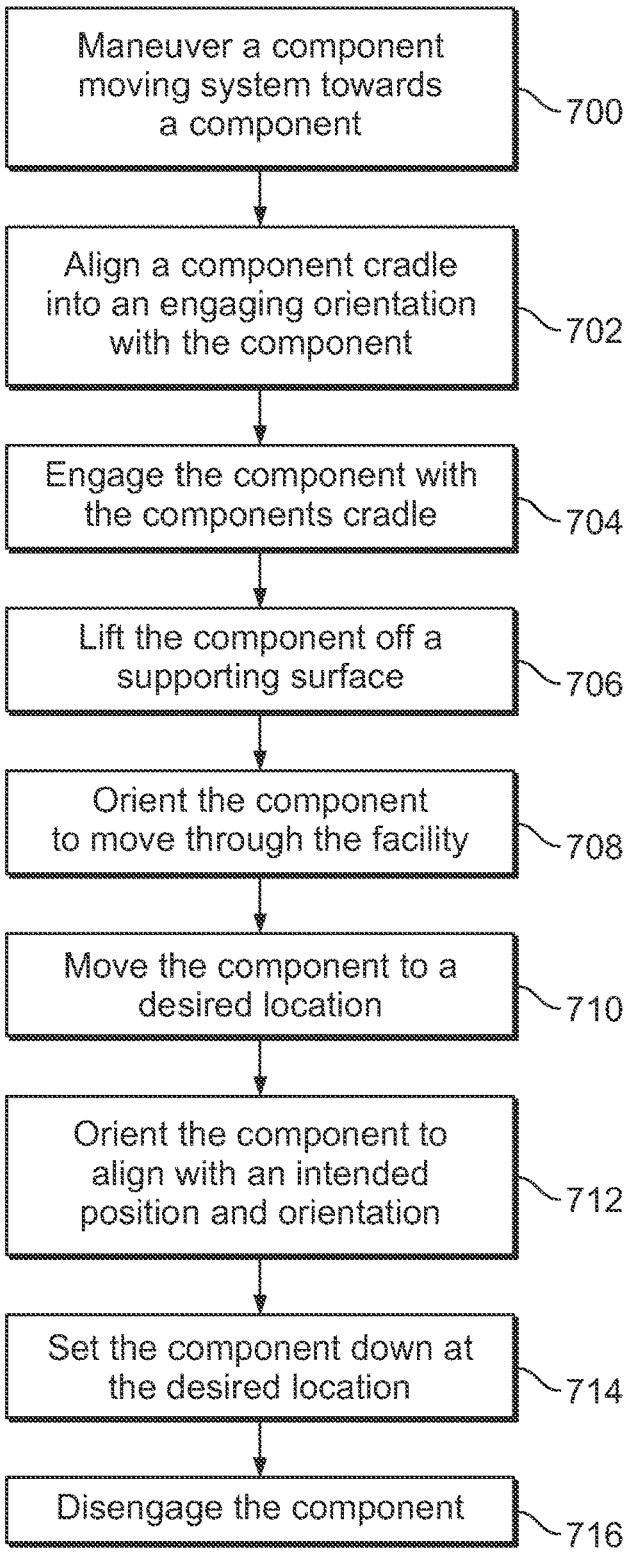
FIG. 18 illustrates a flow chart of a method of moving a component within a facility, according to an embodiment of the present disclosure.

FIG. 18 illustrates a flow chart of a method of moving a component within a facility, according to an embodiment of the present disclosure. The method begins at 700, in which a component moving system is driven, steered, or otherwise maneuvered towards a component. At 702, the component moving assembly is moved, such as with respect to at least one of seven degrees of freedom, to align a component cradle into an engaging orientation with the component. At 704, the component is engaged by the component cradle. For example, the component cradle may be raised up into a lower surface of the component, or the component may be hung from the component cradle.

At 706, the component is lifted off the supporting surface. For example, lift brackets may be actuated to raise the component cradle, and therefore lift the component off the supporting surface. At 708, the component moving assembly is operated to orient the component in various positions and orientations so that it may be moved on the ground through the facility.

At 710, the component moving assembly moves the component to a desired location, such as an assembly site. At 712, the component moving assembly is operated to orient the component to align with an intended position and orientation at the desired location. For example, the component moving assembly may move the component, such as with respect to at least one of seven degrees of freedom, to the intended position and orientation. Once in the intended the position and orientation, the component moving assembly sets the component down at the desired location at 714. After the component is in the intended position and orientation at the desired location, the component moving assembly disengages the component at 716, and may then be moved away from the component.

Referring to FIGS. 1-18, embodiments of the present disclosure provide efficient systems and methods of moving large components within a facility. The systems and methods are used to move components on the ground, so that an overhead crane may be used to move other components. Embodiments of the present disclosure provide efficient methods of manufacturing a vehicle, such as a commercial aircraft, by efficiently moving components on the ground, thereby reserving an overhead crane for other uses. As described above, embodiments of the present disclosure may be used to move various large components, such as wings and landing gear, to an assembly site where a fuselage may be located. Embodiments of the present disclosure provide ground-based systems and methods for transporting components within a facility. For example, embodiments of the present disclosure provide ground-based systems and methods for loading wings and landing gear into or onto installation tooling, thereby allowing an overhead crane to be utilized for other tasks.

Figure 19:
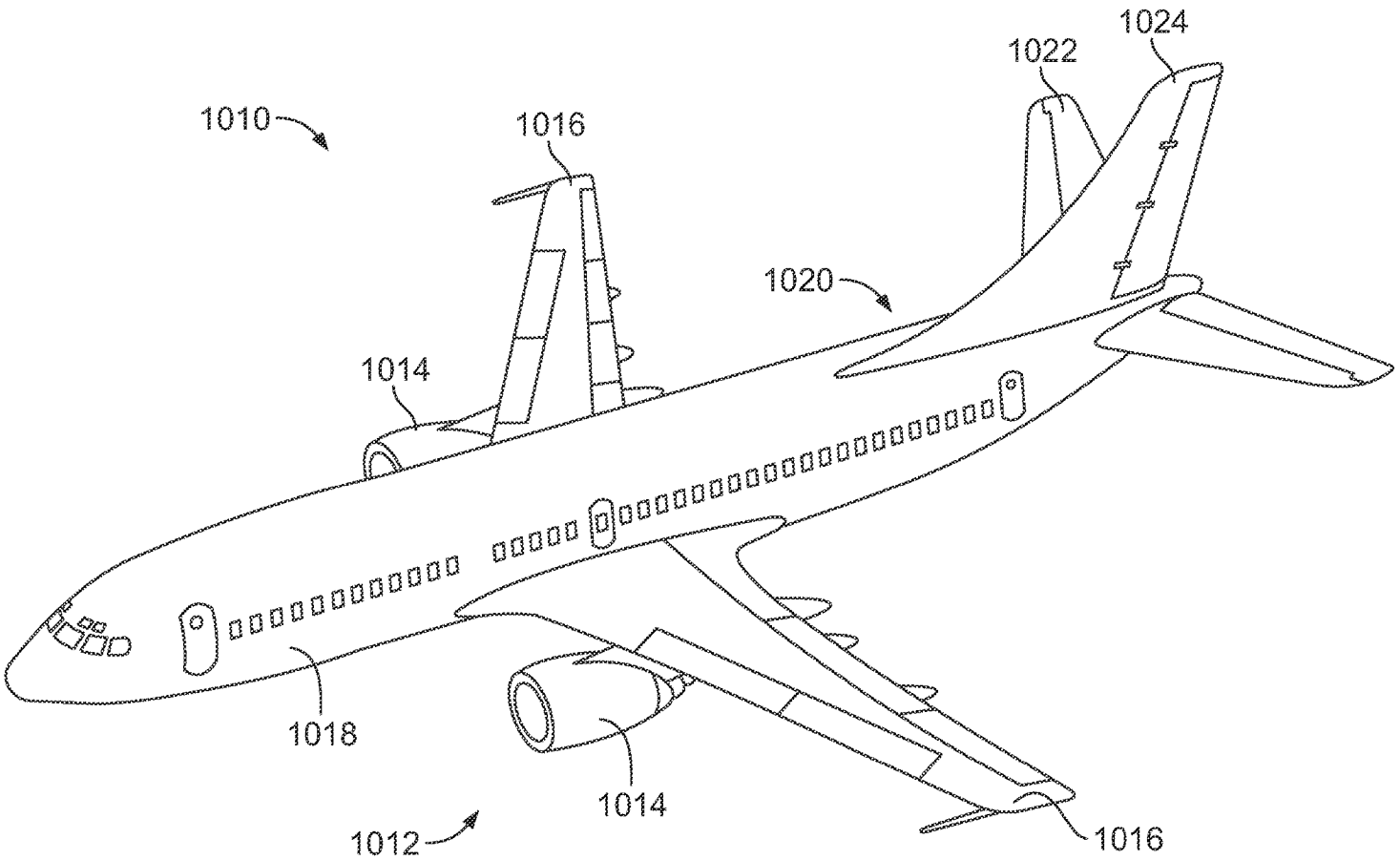
FIG. 19 illustrates a perspective top view of an aircraft, according to an embodiment of the present disclosure.

FIG. 19 illustrates a perspective top view of an aircraft 1010 (or aircraft assembly), according to an embodiment of the present disclosure. The aircraft 1010 is an example of a vehicle having various components that may be assembled together. During the manufacturing process, a component moving system, such as described in the present application, may be used to move various components of the aircraft 1010 to an assembly site. Alternatively, instead of an aircraft, the systems and methods of embodiments of the present disclosure may be used with various other vehicles, such as automobiles, buses, locomotives and train cars, watercraft, spacecraft, and the like.

The aircraft 1010 may include a propulsion system 1012 that may include two turbofan engines 1014, for example. Optionally, the propulsion system 1012 may include more engines 1014 than shown. The engines 1014 are carried by wings 1016 of the aircraft 1010. In other embodiments, the engines 1014 may be carried by a fuselage 1018 and/or an empennage 1020. The empennage 1020 may also support horizontal stabilizers 1022 and a vertical stabilizer 1224. Alternatively, wings may be configured to replace the functionality of an empennage, such as a flying wing aircraft.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A component moving system, comprising:

a cart including a main body, one or more steerable drive wheel assemblies, and first and second outriggers extending outwardly from a lower portion of the main body, wherein each of the first and second outriggers comprises a support wheel assembly including one or more independently-steered support wheels that are steered independently of the one or more steerable drive wheel assemblies; and a component support assembly coupled to the cart, wherein the component support assembly comprises:

a component cradle moveable in first linear translational directions, second linear translational directions that are orthogonal to the first linear translational directions, third linear translation directions that are orthogonal to the first and second linear translational directions, and first rotational directions;

one or more support columns;

one or more lift brackets moveably secured to the one or more support columns;

at least one engaging pad configured to abut into a surface of a component;

at least one support configured to mate with a reciprocal access port formed in the component; and at least one moveable beam that is moveable between positions to accommodate components of different shapes and sizes.

2. The component moving system of claim 1, wherein the cart is moveable in a forward direction, a reverse direction, a right direction, a left direction, and second rotational directions.

3. The component moving system of claim 1, wherein the first linear translational directions are lateral linear directions, wherein the second linear translational directions are longitudinal linear directions, and wherein the third linear translational directions are vertical linear directions.

4. The component moving system of claim 1, wherein the component cradle is configured to support a component above a support surface and below a support surface.

5. The component moving system of claim 1, wherein the one or more steerable drive wheel assemblies comprises:

one or more drive wheels; and one or more drive motors configured to drive the one or more drive wheels.

6. The component moving system of claim 5, wherein the one or more steerable drive wheel assemblies comprises one or more steering motors configured to steer the one or more drive wheels.

7. The component moving system of claim 5, wherein the one or more steerable drive wheel assemblies comprises two coaxial drive wheels, and wherein each of the two coaxial drive wheels is differentially driven by the one or more drive motors.

8. The component moving system of claim 1, wherein the support wheel assembly further comprises one or more steering motors coupled to the one or more support wheels, wherein the one or more steering motors are configured to steer the one or more support wheels.

9. The component moving system of claim 1, wherein the component cradle comprises one or more hanging brackets extending downwardly from the component cradle, wherein the hanging brackets are configured to support a component below the component cradle.

10. The component moving system of claim 1, wherein the component support assembly further comprises a table including a fixed base and a frame rotatably secured to the fixed base, wherein the component cradle is coupled to the frame, and wherein rotation of the frame relative to the fixed base causes rotation of the component cradle in the first rotational directions.

11. The component moving system of claim 1, wherein the component support assembly further comprises first translators and second translators coupled to the component cradle, wherein the first translators are configured to move the component cradle in the first linear translational directions, and wherein the second translators are configured to move the component cradle in the second linear translational directions.

12. The component moving system of claim 1, wherein the one or more lift brackets are coupled to the component cradle, and wherein the one or more lift brackets are configured to move the component cradle through the third linear directions.

13. The component moving system of claim 1, wherein the component cradle is above the cart, and wherein the component cradle is configured to support a component.

14. A component moving system, comprising:

a cart moveable in a forward direction, a reverse direction, a right direction, a left direction, and first rotational directions, wherein the cart comprises: (a) a main body having a housing, (b) first and second outriggers extending outwardly from a lower portion of the housing, wherein each of the first and second outriggers comprises a support wheel assembly comprising one or more independently-steered support wheels, and (c) one or more steerable drive wheel assemblies, wherein at least one of the drive wheel assemblies comprises one or more drive wheels coupled to the main body, and one or more drive motors configured to drive the one or more drive wheels, wherein the or more independently-steered support wheels are steered independently of the one or more drive wheel assemblies; and a component support assembly coupled to the cart, wherein the component support assembly includes:

a component cradle that is configured to support a component above and below a support surface, wherein the component cradle is moveable in lateral linear translational directions, longitudinal linear translational directions that are orthogonal to the lateral linear translational directions, vertical linear translation directions that are orthogonal to the lateral and longitudinal linear translational directions, and second rotational directions;

one or more support columns;

one or more lift brackets moveably secured to the one or more support columns;

at least one engaging pad configured to abut into a surface of a component; and at least one support configured to mate with a reciprocal access port formed in the component; and at least one moveable beam that is moveable between positions to accommodate components of different shapes and sizes.

15. The component moving system of claim 14, wherein the at least one of the drive wheel assemblies comprises one or more steering motors configured to steer the one or more drive wheels.

16. The component moving system of claim 14, wherein the one or more drive wheels comprises two coaxial drive wheels, and wherein each of the two coaxial drive wheels is differentially driven by the one or more drive motors.

17. The component moving system of claim 14, wherein the support wheel assembly further comprises one or more steering motors coupled to the one or more independently-steered support wheels.

18. The component moving system of claim 14, wherein the component cradle comprises one or more hanging brackets extending downwardly from the component cradle, wherein the hanging brackets are configured to support a component below the component cradle.

19. The component moving system of claim 14, wherein the component support assembly further comprises:

a table including a fixed base and a frame rotatably secured to the fixed base, wherein the component cradle is coupled to the frame, and wherein rotation of the frame relative to the fixed base causes rotation of the component cradle in the second rotational directions about a central axis of the table;

first translators and second translators coupled to the component cradle and the frame, wherein the first translators are configured to move the component cradle in the lateral linear translational directions, and wherein the second translators are configured to move the component cradle in the longitudinal linear translational directions, wherein the one or more lift brackets are coupled to the fixed base, and wherein the one or more lift brackets are configured to move the component cradle through the vertical linear directions.

20. The component moving system of claim 14, wherein the component cradle is above the cart, and wherein the component cradle is configured to support the component.

21. A component moving system, comprising:

a cart moveable in a forward direction, a reverse direction, a right direction, a left direction, and first rotational directions, wherein the cart comprises:

a main body having a housing;

parallel outriggers extending outwardly from a lower portion of the housing, wherein each of the parallel outriggers comprises a support wheel assembly comprising one or more independently-steered support wheels; and three drive wheel assemblies, wherein each of the three drive wheel assemblies comprises a pair of coaxially differentially-driven wheels coupled to the main body;

a component support assembly coupled to the cart, wherein the component cradle is configured to support a component above and below a support surface, wherein the component support assembly comprises:

a component cradle moveable in lateral linear translational directions, longitudinal linear translational directions that are orthogonal to the lateral linear translational directions, vertical linear translation directions that are orthogonal to the lateral and longitudinal linear translational directions, and second rotational directions, wherein the component cradle comprises one or more hanging brackets extending downwardly from the component cradle, wherein the hanging brackets are configured to support a component below the component cradle;

a table including a fixed base and a frame rotatably secured to the fixed base, wherein the component cradle is coupled to the frame, and wherein rotation of the frame relative to the fixed base causes rotation of the component cradle in the second rotational directions about a central axis of the table;

first translators and second translators coupled to the component cradle and the frame, wherein the first translators are configured to move the component cradle in the lateral linear translational directions, and wherein the second translators are configured to move the component cradle in the longitudinal linear translational directions;

a pair of support columns;

a pair of lift brackets moveably secured to the pair of support columns, wherein the pair of lift brackets is coupled to the fixed base, and wherein the pair of lift brackets is configured to move the component cradle through the vertical linear directions;

at least one engaging pad configured to abut into a surface of a component;

at least one oval support configured to mate with a reciprocal oval access port formed in the component; and at least one moveable beam that is moveable between positions to accommodate components of different shapes and sizes.

* * * * *